US008393119B2

(12) United States Patent
Alsaif

(10) Patent No.: US 8,393,119 B2
(45) Date of Patent: Mar. 12, 2013

(54) SMART ISOLATION BASE FOR SENSITIVE STRUCTURES SUCH AS NUCLEAR POWER PLANTS AGAINST EARTHQUAKE DISTURBANCES

(75) Inventor: Khalid A. Alsaif, Riyadh (SA)

(73) Assignees: King Abdulaziz City of Science and Technology, Riyadh (SA); King Saud University, Riyadh (SA)

( * ) Notice: Subject to any disclaimer, the term of this patent is extended or adjusted under 35 U.S.C. 154(b) by 0 days.

(21) Appl. No.: 12/954,100

(22) Filed: Nov. 24, 2010

(65) Prior Publication Data

US 2012/0124920 A1 May 24, 2012

(51) Int. Cl.
*E04B 1/98* (2006.01)
*E04H 9/02* (2006.01)

(52) U.S. Cl. ..... 52/167.6; 52/167.8

(58) Field of Classification Search .. 52/1, 167.1–167.8; 248/550; 384/8, 36, 49
See application file for complete search history.

(56) References Cited

U.S. PATENT DOCUMENTS

| | | | | | |
|---|---|---|---|---|---|
| 951,028 | A * | 3/1910 | Schar | 52/167.5 |
| 4,402,483 | A * | 9/1983 | Kurabayashi et al. | 248/636 |
| 4,517,778 | A * | 5/1985 | Nicolai | 52/167.5 |
| 4,565,039 | A * | 1/1986 | Oguro et al. | 52/167.4 |
| 4,881,350 | A * | 11/1989 | Wu | 52/167.5 |
| 7,337,586 | B2 * | 3/2008 | Lin et al. | 52/167.1 |
| 2006/0260221 | A1 * | 11/2006 | Kemeny | 52/167.5 |

* cited by examiner

*Primary Examiner* — Brian Glessner
*Assistant Examiner* — Brian D Mattei
(74) *Attorney, Agent, or Firm* — Andrew M. Calderon; Roberts Mlotkowski Safran & Cole, P.C.

(57) ABSTRACT

An isolation base system for sensitive structures such as nuclear power plant modules is suggested. The proposed isolation system considers a base supported on specially designed hollow spherical balls and equipped with 3 linear hydraulic actuators to restrict the lateral motion of the base and provide a stable base under normal conditions. The actuators are released when an earthquake signal is detected to allow the base to oscillate freely during the earthquake attack. The hydraulic actuators are reactivated after shock wave ends to compress the springs and restore the base to its original position.

15 Claims, 5 Drawing Sheets

SMART ISOLATION BASE FOR SENSITIVE STRUCTURES SUCH AS NUCLEAR POWER PLANTS AGAINST EARTHQUAKE DISTURBANCES

CROSS-REFERENCES TO RELATED APPLICATIONS (IF ANY)

None

STATEMENT AS TO RIGHTS TO INVENTIONS MADE UNDER FEDERALLY-SPONSORED RESEARCH AND DEVELOPMENT (IF ANY)

None

BACKGROUND OF INVENTION

1. Field of the Invention

The present invention is directed to a Smart isolation base for sensitive structures such as Nuclear power plants especially against earthquake disturbances.

2. Background

Natural disasters, such as earthquakes, are a cause for alert given the potential disasters. These sensitive structures are structures such as nuclear power plants. There needs to be a way to restrict the lateral motion of the base while providing a stable base under normal conditions to prevent disaster. There is no prior art that efficiently addresses these concerns.

There is still room for improvement in the art.

SUMMARY OF THE INVENTION

The current invention consists of an isolation base system for sensitive structures such as nuclear power plant modules. The proposed isolation system considers a base supported on specially designed hollow spherical balls and equipped with linear hydraulic actuators to restrict the lateral motion of the base and provide a stable base under normal conditions. The actuators are released when an earthquake signal is detected to allow the base to oscillate freely during the earthquake attack. The hydraulic actuators are reactivated after shock wave's ends to compress the springs and restore the base to its original position. Each actuator would consist of a piston—cylinder—compression spring—rubber wheel configuration at the tip to allow for rotation of the base in case of possible torsional misalignment after earthquake shock ends. Seismic Sensors can be placed at an appropriate distance from the base to provide enough time for the controller to release the positioning actuators.

BRIEF DESCRIPTION OF THE DRAWINGS

Without restricting the full scope of this invention, the preferred form of this invention is illustrated in the following drawings.

BRIEF DESCRIPTION OF THE PREFERRED EMBODIMENTS

There are a number of significant design features and improvements incorporated within the invention.

Figure 1:
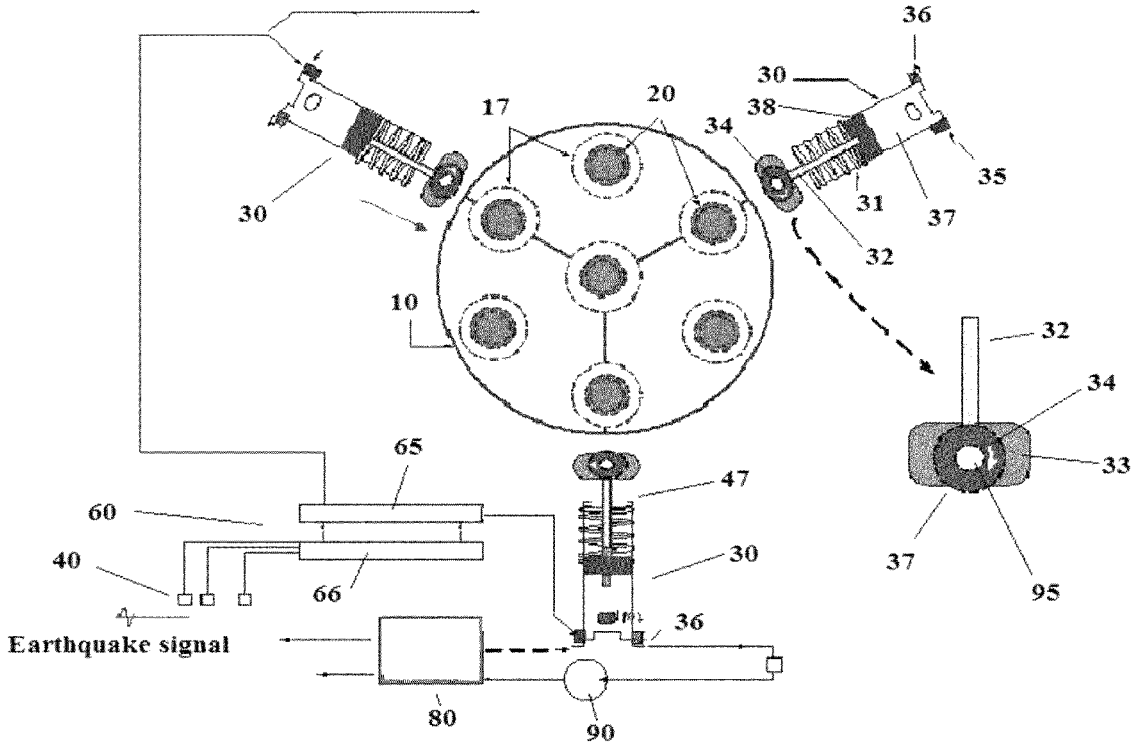
FIG. 1 is FIG. 1 isolation system Top view.

The current invention is an isolation base system for sensitive structures such as nuclear power plant modules. The isolation system, as shown in FIG. 1, considers a base 10 supported on specially designed hollow spherical balls 20 and equipped with 3 linear hydraulic actuators 30 to restrict the lateral motion of the base 10 and provide a stable base under normal conditions. The actuators 30 are released when an earthquake signal is detected to allow the base to oscillate freely during the earthquake attack. The hydraulic actuators 30 are reactivated after shock wave's ends to compress the compression springs 31 and restore the base 10 to its original position.

Each actuator 30 consists of a piston 32, cylinder 33, a compression spring 31 and a rubber wheel 34 at the tip to allow for rotation of the base 10 in case of possible torsional misalignment after earthquake shock ends. Seismic Sensors 40 can be placed at an appropriate distance from the base 10 to provide enough time for the controller 50 to release the positioning actuators 30. The actuators 30 in the preferred embodiment are connected to a solid structure or ground and have a pivot 39 allowing them to maximize through connection to the top base 14.

The major components are:

Hollow balls 20 that are rolling with no slipping condition. The ball 20 diameter and thickness can be selected based on optimization of the response of the structure and the base 10 lateral movement and to keep stresses on the ball 20 as it rolls within acceptable limits. The balls 20 can be made from steel and their weight can be minimized keeping the internal stress within the allowable limits. The number of balls 20 can be selected based on the total weight of the nuclear facility structure to be isolated. There are contact and internal stresses on the ball 20 for both static (no earthquake) and dynamic (during shock disturbance) conditions and therefore the thickness of the hollow ball 20 can be determined to prevent structural failure of the ball 20 by keeping these stresses below allowable value.

Figure 4:
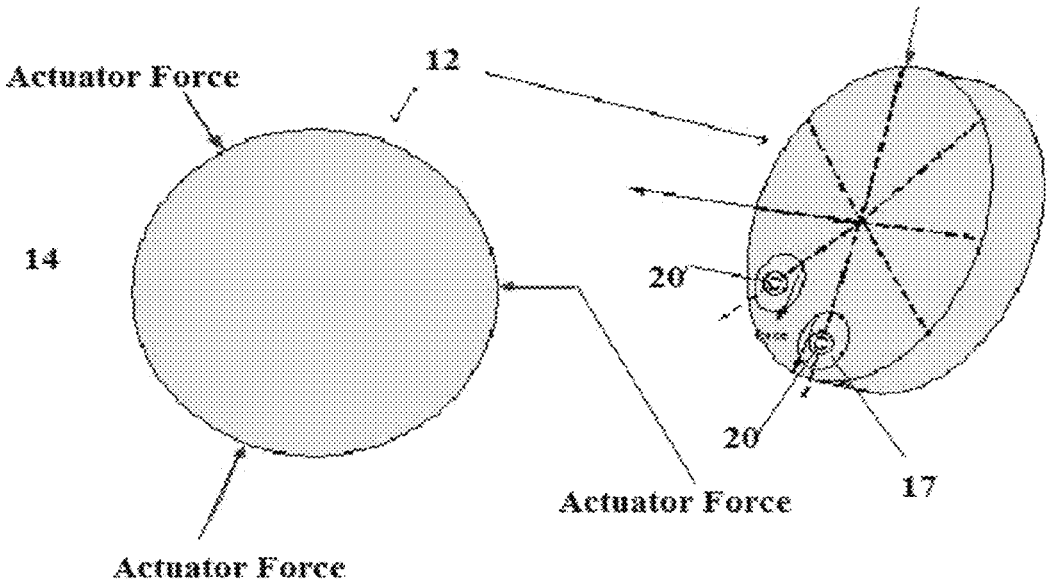
FIG. 4 is a required force to move the top part of the base.

Three hydraulic actuators 30 with rotatable wheels at the tip: the actuators 30 consist of a piston chamber 37, hydraulic piston 32, cylinder 33, compression spring 31 with constant K—rubber wheel 34 at the tip of the actuators 30 to allow for rotation of the base 10 in case of possible torsional misalignment of the base 10. The required actuator 30 force to keep the base secure when there is no earthquake disturbance can be calculated as shown in FIG. 4. The cylinder 33 is attached to the piston 32 with a rubber wheel 34 on the cylinder 33. In the preferred embodiment, the spring 31 in within the piston chamber 37 where it compresses against the piston head 38 and a lip 47 of the piston chamber 37. This will apply force to the piston head 38 to release the actuator 30 from the base 10 during an event.

In the preferred embodiment, the wheel 34 turns on an axle 95 connected to the cylinder 33.

In the preferred embodiment, the top base 14 is circular in shape and there are three equally spaced actuators 30 used to secure the top base 14 as shown in FIG. 1.

Several seismic sensors 40 are used to detect possible earthquake disturbance which are connected to the controller 60 to tell it if there is earthquake activity and at what level.

A plurality of signal condition units are used to amplify the acquired signal by the sensors.

Figure 2:
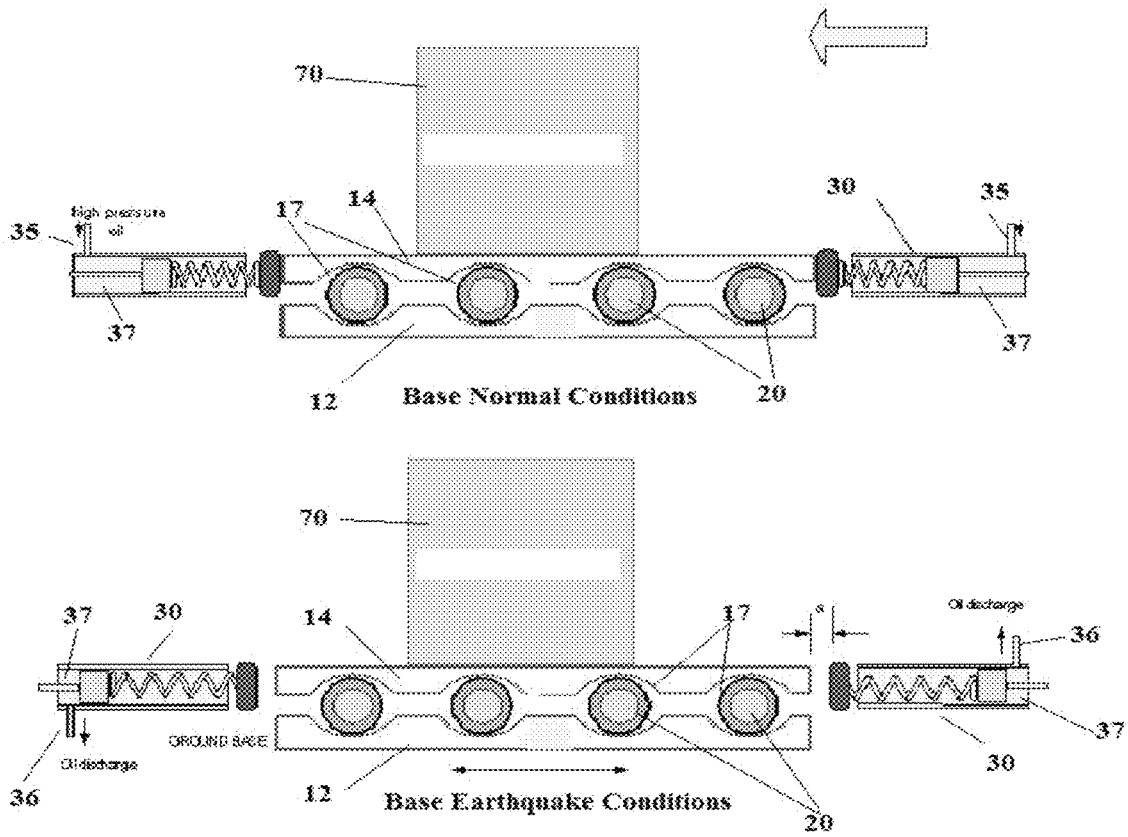
FIG. 2 is a Front view of the base isolation.

A Controller 60 is used to open the inlet valves 35 of the three actuators 30 in case of no earthquake for the high pressure oil to be pumped using an oil pump 90 from an oil reserve 80 into a piston chamber 37 to press the piston 36 towards the base 10 such that the tip wheel 34 will firmly contact the base and secure it as shown in FIG. 2. The controller 60 can consist of a signal conditioning unit 65 to pick up the seismic pick-ups connected to a computer-controller 66 which communicates to the actuators 30.

The controller 60 will activate the exit valve 36 to release the pressure inside the actuator 30 during earthquake attack and allow the spring 31 to expand creating a gap, as shown in FIG. 2, between the base 10 and the actuator tip 37 limiting the effects of the earthquake on the base 10. This can be done during any earthquake or only those of a significant level.

The base 10 consists of a ground base 12 and the base top 14 on which sits the sensitive building such as a nuclear power plant or bridge 70. The base top 14 rests on top of a plurality of hollow balls 20 which are placed in concaved ball depressions 17 in the ground base 12 and are in ball depression 17 on the bottom of the base top 14. These hollow balls 20 hold up the structure 70.

Figure 3:
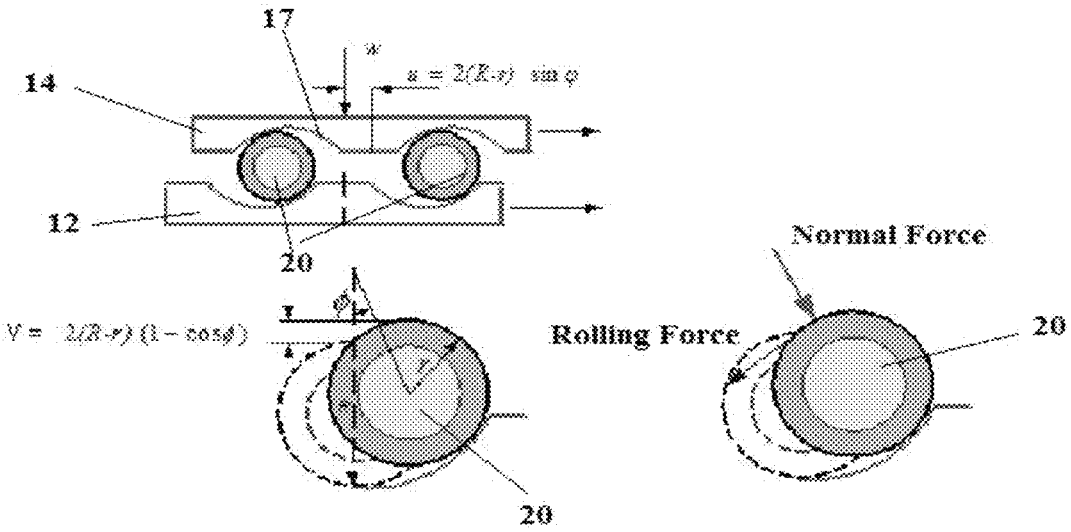
FIG. 3 is a kinematics and dynamics of the base-ball system.

FIG. 3 displays the kinematics and dynamics of the base-ball system and FIG. 4 shows the required force to move the top part plate of the base 10. It shows the Actuator force against the base 10 as well as the ground base 12 with the balls 20 in the ball depressions 17.

Figure 5:
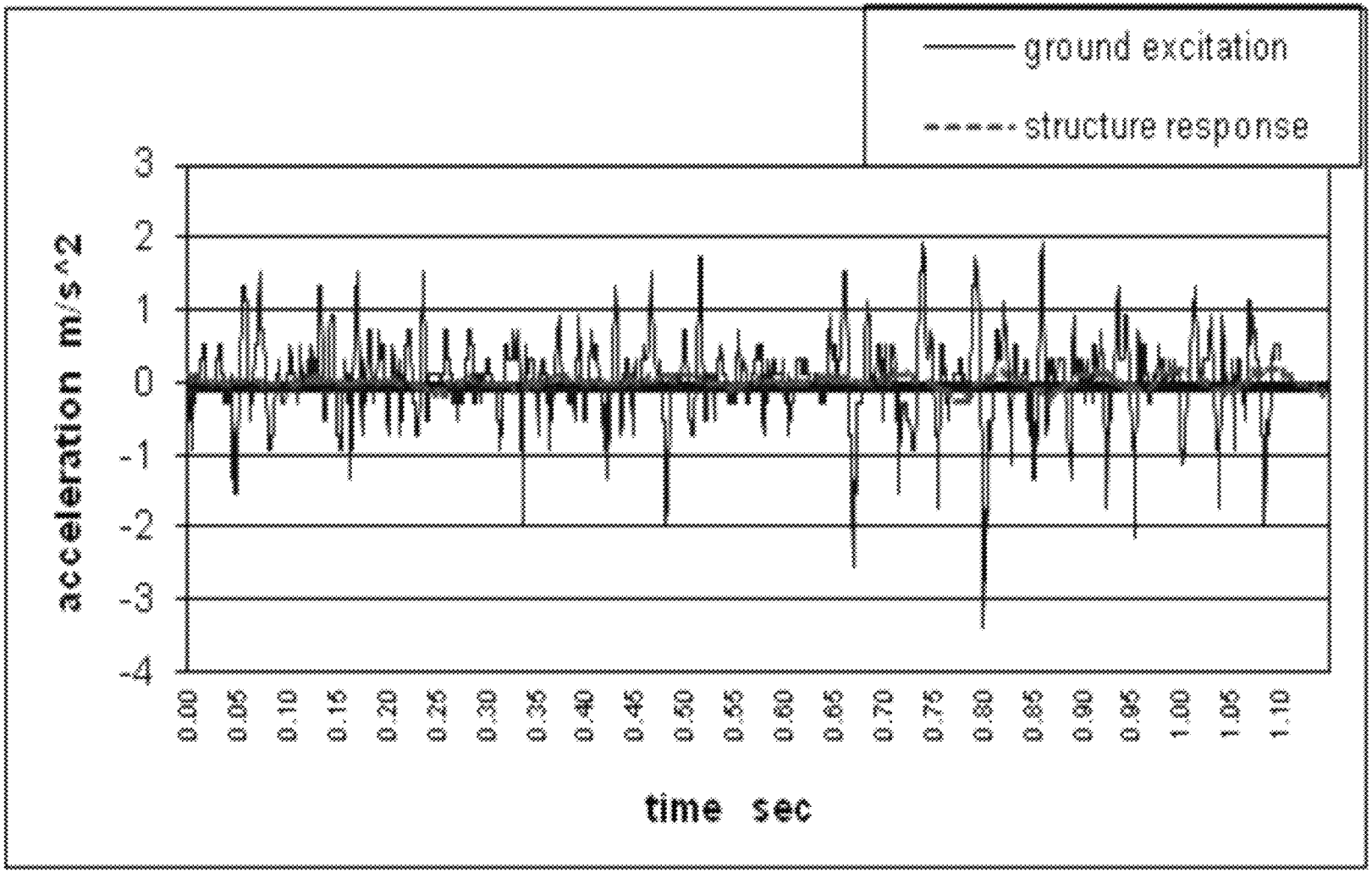
FIG. 5 is a Measurement of Acceleration Response of structure isolated by balls due to earthquake signal.

FIG. 5 is a graph that confirms the performance of the ball isolation system as the movement from the earthquake is greatly reduced from the non-protected ground.

As to a further discussion of the manner of usage and operation of the present invention, the same should be apparent from the above description. Accordingly, no further discussion relating to the manner of usage and operation will be provided.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for protecting sensitive structures comprising: a base comprised of a base top and a ground base with said base top sitting on balls which are sitting on the ground base with the structure sitting on the base top and having a plurality of actuators that contact and hold the base top and release the base top during an event where said actuators comprised of a hydraulic chamber, hydraulic piston, cylinder, compression spring and rubber wheel.

2. A device according to claim 1 further comprising having said balls being held in ball depressions in the base top and ground base.

3. A device according to claim 1 further comprising where said event is an earthquake.

4. A device according to claim 1 further comprising having said rubber wheel rotate.

5. A device according to claim 1 further comprising having said spring applying pressure to the piston head and a hydraulic chamber lip.

6. A device according to claim 1 further comprising having hydraulic fluid being pumped into the hydraulic chamber to push against the hydraulic piston so that the cylinder will hold the top base in place.

7. A device according to claim 1 further comprising having hydraulic fluid being released from the hydraulic chamber allowing the spring to push against the hydraulic piston releasing the cylinder from the top base.

8. A device according to claim 1 further comprising seismic sensors connected to a controller which controls having hydraulic fluid being pumped into the hydraulic chamber to push against the hydraulic piston so that the cylinder will hold the top base in place and controls having hydraulic fluid being released from the hydraulic chamber allowing the spring to push against the hydraulic piston releasing the cylinder from the top base where said controller will release said hydraulic fluid when the seismic sensors detect an event.

9. A device according to claim 8 further comprising having the controller activate an exit valve to release the pressure inside the hydraulic chamber.

10. A process for protecting sensitive structures comprising: having a base comprised of a base top and a ground base, having said base top sitting on balls which are sitting on the ground base, having the structure sitting on the base top and having said balls being held in ball depressions in the base top and ground base and having a plurality of actuators that contact and hold the base top and release the base top during an event where said actuators are comprised of a hydraulic chamber, hydraulic piston, cylinder, compression spring and rubber wheel.

11. A process according to claim 10 further comprising where said event is an earthquake.

12. A process according to claim 10 further comprising having said rubber wheel rotate.

13. A process according to claim 10 further comprising having said spring applying pressure to the piston head and a hydraulic chamber lip.

14. A process according to claim 10 further comprising having hydraulic fluid being pumped into the hydraulic chamber to push against the hydraulic piston so that the cylinder will hold the top base in place.

15. A process according to claim 10 further comprising having seismic sensors connecting to a controller which controls, having hydraulic fluid being pumped into the hydraulic chamber to push against the hydraulic piston so that the cylinder will hold the top base in place and controls having hydraulic fluid being released from the hydraulic chamber allowing the spring to push against the hydraulic piston releasing the cylinder from the top base where said controller will release said hydraulic fluid when the seismic sensors detect an event.

* * * * *